US005114362A

United States Patent [19]

Olsson

[11] Patent Number: 5,114,362

[45] Date of Patent: May 19, 1992

[54] HIGH DENSITY ELECTRICAL CONNECTOR AND METHOD OF MAKING A HIGH DENSITY ELECTRICAL CONNECTOR

[75] Inventor: Billy E. Olsson, New Cumberland, Pa.

[73] Assignee: AMP Incorporated, Harrisburg, Pa.

[21] Appl. No.: 660,757

[22] Filed: Feb. 25, 1991

[51] Int. Cl.[5] ..... H01R 13/58

[52] U.S. Cl. ..... 439/460; 439/494; 439/499; 29/857

[58] Field of Search ..... 439/350, 351, 357, 358, 439/404, 459, 460, 492, 493, 494, 499, 495, 497, 498; 29/857, 865

[56] References Cited

U.S. PATENT DOCUMENTS

| | | | |
|---|---|---|---|
| 4,367,909 | 1/1983 | Shatto, Jr. et al. | 339/176 MF |
| 4,537,455 | 8/1985 | Vertenten et al. | 439/404 |
| 4,600,259 | 7/1986 | Olsson | 339/99 R |
| 4,693,533 | 9/1987 | Szczesny et al. | 439/350 |
| 4,747,787 | 5/1988 | Siwinski | 439/108 |
| 4,861,272 | 8/1989 | Clark | 439/483 X |
| 4,869,685 | 9/1989 | Olsson | 439/404 |

FOREIGN PATENT DOCUMENTS

| | | | |
|---|---|---|---|
| 0282194 | 9/1988 | European Pat. Off. | 439/460 |

OTHER PUBLICATIONS

U.S. Pat. Appl. Ser. No. 07/502,941; filed Mar. 20, 1990.

*Primary Examiner*—Eugene F. Desmond

*Attorney, Agent, or Firm*—Eric J. Groen; Bruce J. Wolstoncroft

[57] ABSTRACT

A high density ribbon cable connector includes bipartite strain relief halves adapted to trap between them a high density ribbon cable. The strain relief halves and ribbon are snap latchable into position within a fixture housing with the cable extending through an elongate slot in the fixture housing, and adjacent to a fixture face having conductor aligning grooves emanating from and fanning out in opposite directions from the elongate slot. The grooves form a template for the positioning of the conductors for accurate alignment prior to termination. The fixture housing also includes terminal clearance slots aligned with each groove, where two rows of clearance slots are provided on each side of the slot. The fixture housing is snap latchable into a terminal housing, where conductor receiving slots of electrical terminals are inserted into the terminal clearance slots, and electrically terminate the conductors to the electrical terminals.

19 Claims, 9 Drawing Sheets

HIGH DENSITY ELECTRICAL CONNECTOR AND METHOD OF MAKING A HIGH DENSITY ELECTRICAL CONNECTOR

BACKGROUND OF THE INVENTION

1. Field of the Invention

The invention is directed to a high density electrical connection system for terminating to a high density ribbon cable.

2. Description of the Prior Art

The development of new electrical cables in which a large number of wires are encapsulated in a flat insulating web has produced significant advantage in computers, telecommunication devices, and in electronics generally. These cables are manufactured with conductors formed as fine parallel wires, as small as 0.2 millimeter (mm) in diameter (0.008 inches) on 0.5 mm centerlines. These conductors may be used for transmitting electrical power or, in the alternative, electrical signals. Advantageously, then it should be appreciated that these high density cables produce a significantly smaller, and higher density package.

Along with the obvious advantages of size reduction and package density, such flat ribbon cables also present certain disadvantages. For example, with the conductors separated by only 0.5 mm, the common approach of insulation piercing technology is ruled out. Rather, an entirely new approach must be taken with such small wires, and small wire spacings. With such small packages, the conventional techniques of molding and stamping are also stretched to their limits in terms of tolerances.

Furthermore, such wire connectors are adapted for connection with pin headers on printed circuit boards. With the increased density of the wire connectors, it is often required to have special fixtures for wave soldering the pin headers to the printed circuit boards to prevent solder from wicking between and commoning adjacent posts. For example, if adjacent pins in the header are closer than 0.050 inches apart, special tooling is required to prevent solder wicking. Thus, it would be advantageous if the wire connector would dictate a pin header design which would not require such special fixtures.

While connector systems are known generally in the art for terminating ribbon cable conductors to further conductors, such systems are not suitable for use with such high density cables.

For example, U.S. Pat. No. 4,367,909 to Shatto, Jr., et al shows an electrical connector having housing parts with wire receiving grooves in which the cables reside for alignment with insulation displacement type electrical terminals. The terminals are also disposed in more than one row to stagger the positioning of the terminals, allowing the wire alignment grooves to be spaced further apart. Even with the staggered rows of electrical terminals, this type of electrical connection system is not capable for use with such high density systems.

In one attempt to accommodate high density ribbon cables, U.S. Pat. No. 4,747,787 to Siwinski, an electrical connection system positions terminals into three rows. The ends of the ribbon cable are stripped, and the conductors are formed to meet the terminal rows. Some of the conductors are maintained in the same plane as the ribbon cable, and these conductors are aligned with the center row of electrical terminals. Some of the bared conductors are bent upwardly to one side of the cable to meet the terminals in one outer row, while the remainder of the terminals are bent in the opposite direction to meet the remaining row of terminals. The wires are thereafter soldered to the terminals to electrically connect the two together. While the system bears utility for some applications, other such applications differ, for example, many applications require a solderless installation process.

An object of the present invention then is to provide an electrical connection system for interconnecting to high density ribbon cable as referenced above.

Another object of the invention is to provide an electrical connection system where the terminals of the system can be interconnected to the cable without the requirement of such processes as soldering.

Other objects and advantages of the invention will be apparent from the following description, the accompanying drawings and the appended claims.

SUMMARY OF THE INVENTION

The above objects of the invention were accomplished by providing a connection system comprising strain relief means, comprising bipartite strain relief halves, adapted to clamp the cable from opposite sides, and span the length of the cable. A fixture housing is also included which comprises an upper face and a lower fixture face, the fixture housing including a recessed cavity extending inwardly from the upper face, and an elongate slot continuous with the cavity and extending through the fixture face, the fixture face including a plurality of terminal clearance slots extending therein, and alignment means to position the conductors of the ribbon cable over the terminal clearance slots, the strain relief halves being adapted to position the ribbon cable through the elongate slot, and maintain axial juxtaposition of the cable relative to the fixture face. A terminal housing is also provided where the housing has a mating face and a termination face, and terminal receiving passageways extending between the mating face and the termination face, the terminal receiving passageways being aligned with the terminal clearance slots in the fixture housing. A plurality of electrical terminals are positioned in the terminal receiving passageways, the terminals comprising insulation displacement portions extending above the termination face, the insulation displacement portions being receivable in the terminal receiving slots upon abutment of the terminal housing with the fixture housing.

In an inventive method of providing a high density interconnection with ribbon cable having a plurality of side-by-side conductors encapsulated in insulation comprises the steps of stripping insulation from a free end of the ribbon cable to expose internal conductors. The conductors are then bent upwardly to an angle of approximately 90° relative to a plane of said cable, where alternate conductors are bent in opposite directions. Conductive means are then positioned adjacent to the conductors, where the conductive means are positioned on both sides of the cable in at least two rows, where some of the rows are positioned proximal to the cable, and some of the rows are positioned distal from the cable. The conductors are then electrically connected to the conductive means.

DETAILED DESCRIPTION OF THE PREFERRED EMBODIMENT

Figure 1:
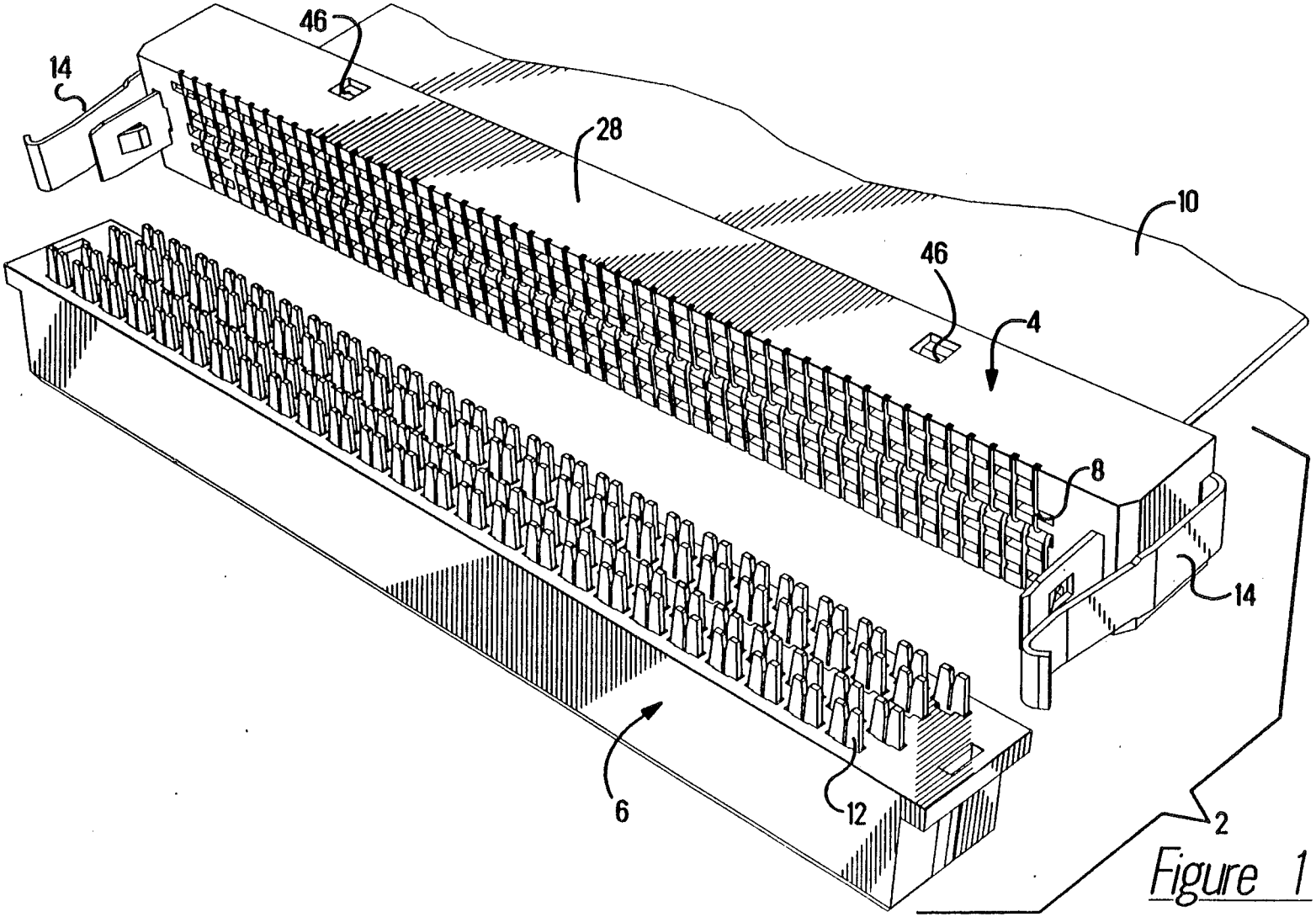
FIG. 1 is a perspective view showing the fixture assembly poised for interconnection with a receptacle assembly.

With reference first to FIG. 1, the invention relates to a high density receptacle shown generally at 2 designed to terminate a 100 position ribbon cable with 0.2 millimeter (mm) conductors on a 0.5 mm centerline spacing. As shown in FIG. 1, the receptacle 2 comprises a cable fixture assembly 4 and a receptacle housing 6. The fixture assembly 4 is profiled to accommodate the individual conductors 8 of a high density ribbon cable 10 such that the individual conductors can be terminated to conductor terminating slots shown generally at 12 in the receptacle housing 6. Clips 14 flanking the fixture assembly 4 are designed to retain the fixture assembly 4 to the receptacle assembly 6 and to provide for latching engagement with a mateable header assembly.

Figure 2:
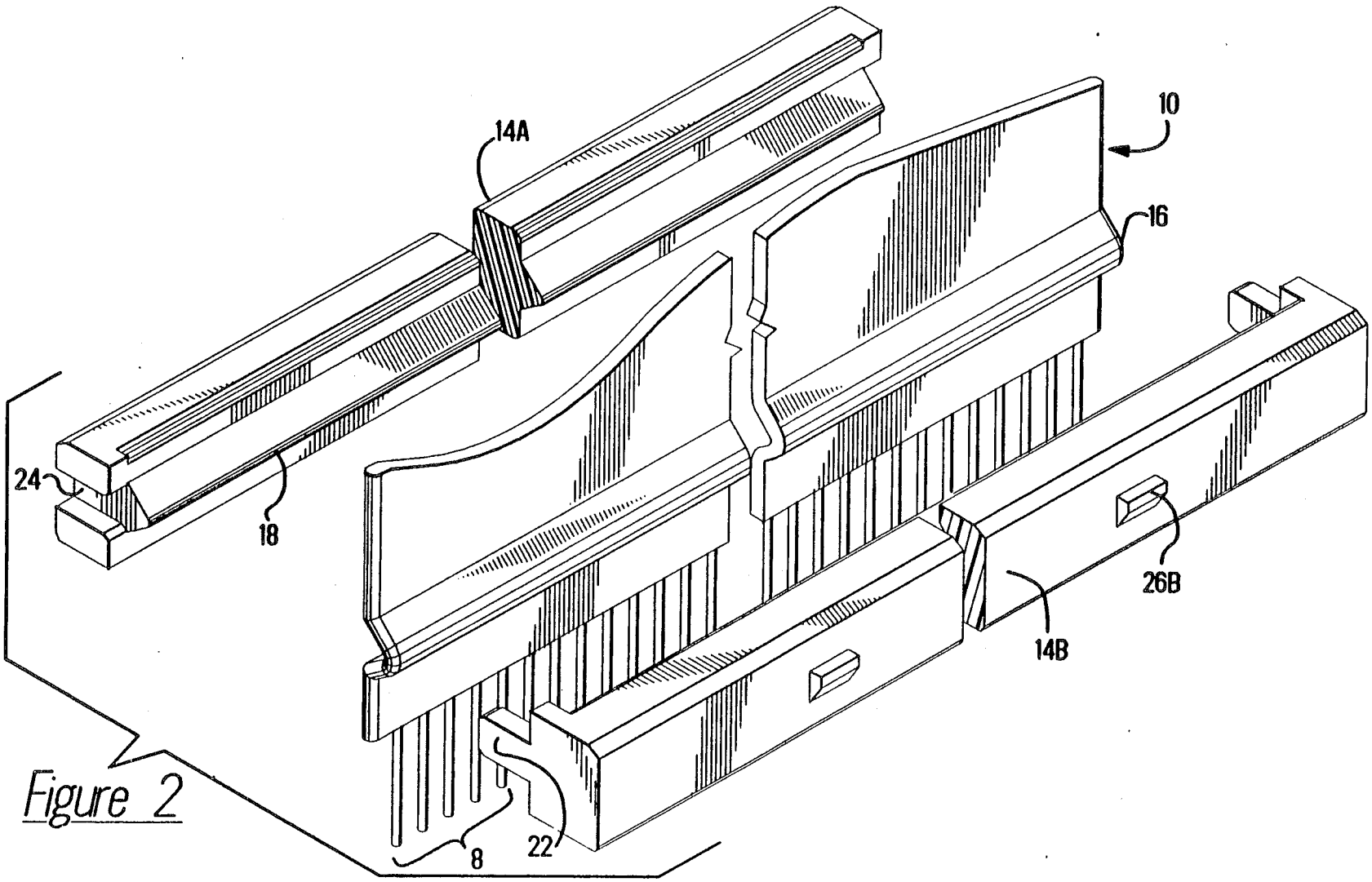
FIG. 2 is a perspective view showing strain relief halves disposed on opposite sides of a high density ribbon cable.
Figure 13:
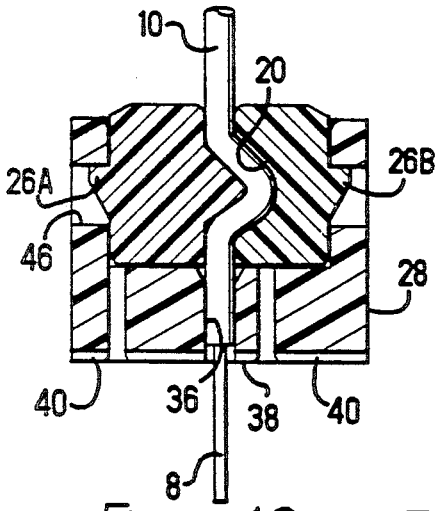
FIG. 13 shows a cross-sectional view of the fixture housing along lines 13—13 of FIG. 5, together with a cross-sectional view of the strain relief halves of FIG. 12.

With reference now to FIG. 2, the fixture assembly 4 comprises two strain relief halves 14*a* and 14*b* which trap between them the high density ribbon cable 10. As shown in FIG. 2, the strain relief half 14*a* includes a V-shaped projection at 18 and the strain relief half 14*b* includes a concave indentation 20 along its length, as shown in FIG. 13. The ribbon cable 10 is prepared to include an undulation at 16 which, when positioned between the strain relief halves 14*a*, 14*b*, is axially held in place, with the undulation 16 positioned between the projection 18 and the indentation 20. The strain relief halves 14*a*, 14*b* further comprise guide posts 22 at the ends of the strain relief half 14*b* and cooperative slots 24 at the ends of the strain relief half 14*a*, to align the two halves properly together. The strain relief half 14*a* includes locking protrusions 26*a* while strain relief half 14*b* includes a locking protrusion 26*b*, as shown in FIG. 13, which will be described in greater detail herein.

Figure 3:
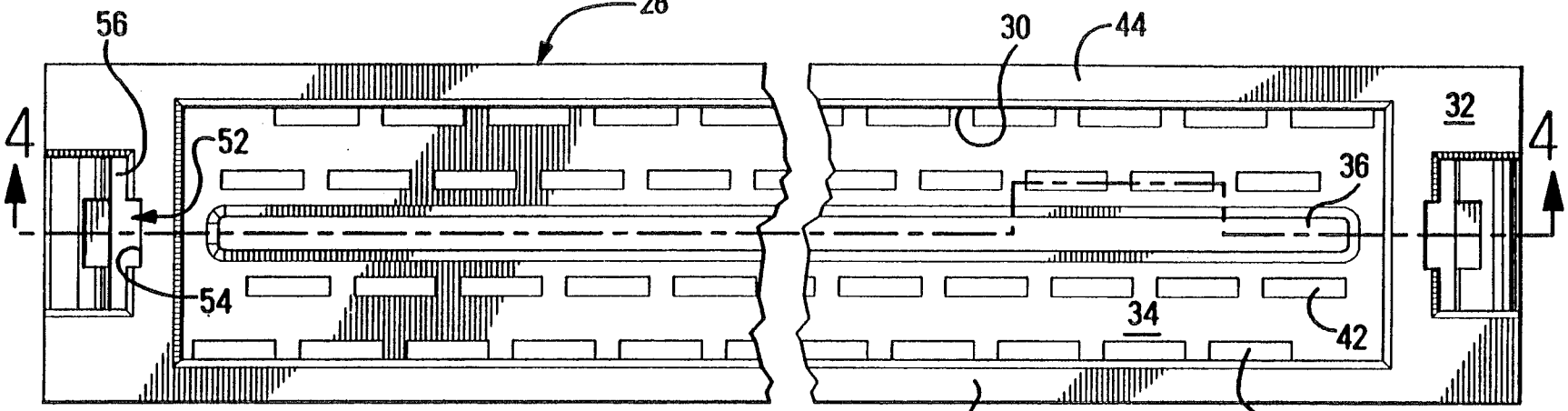
FIG. 3 is a top elevational view of the housing for the fixture assembly.
Figure 4:
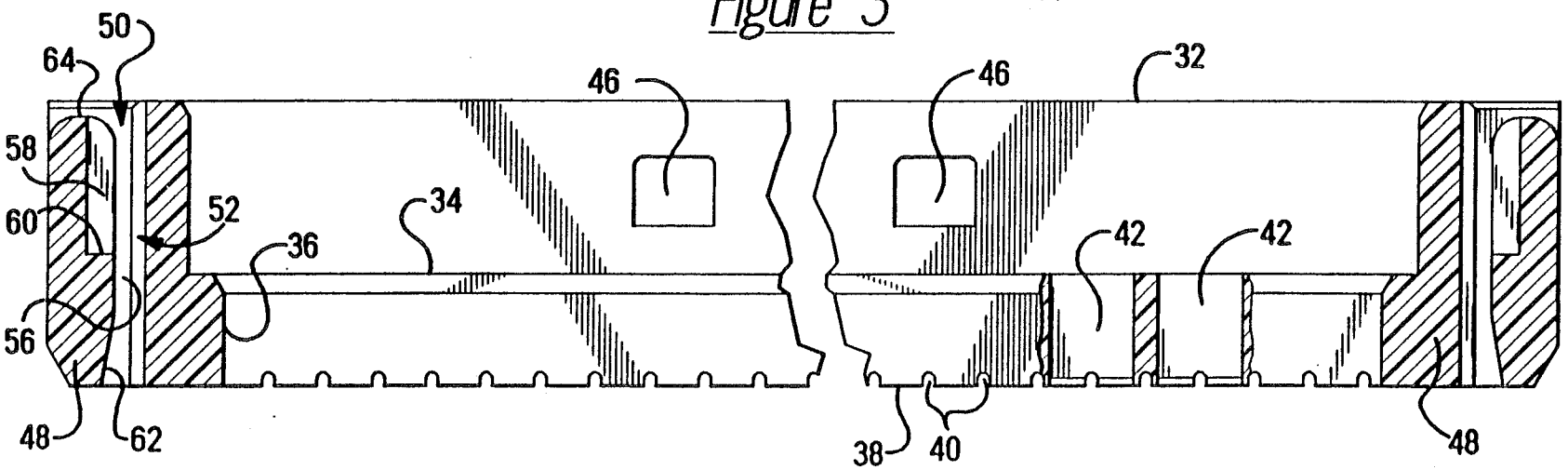
FIG. 4 is a cross-sectional view through lines 4—4 of FIG. 3.
Figure 5:
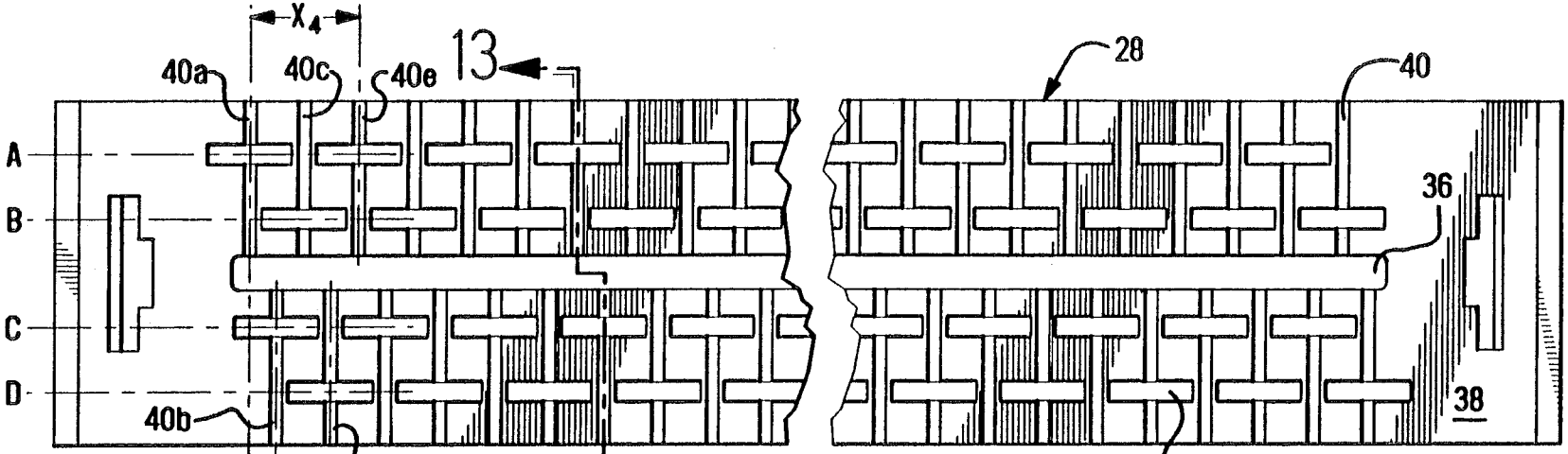
FIG. 5 is a bottom elevational view of the housing of FIGS. 3 and 4.

As shown in FIG. 1, the fixture assembly 4 further comprises an outer housing 28 into which the two strain relief halves 14*a* and 14*b* are inserted. With reference now to FIGS. 3-5, the outer housing 28 will be described in greater detail. The outer housing 28 includes a recessed cavity at 30 which is profiled to accommodate the two strain relief halves and the cable 10. As shown in FIG. 3, the recessed cavity 30 extends downwardly from an upper surface 32 to define a lower floor 34. As shown in FIGS. 3-5, a cable-receiving slot 36 is in communication with the cavity 30 and extends from the floor 34 to a lower surface 38 (FIG. 4).

Figure 15:
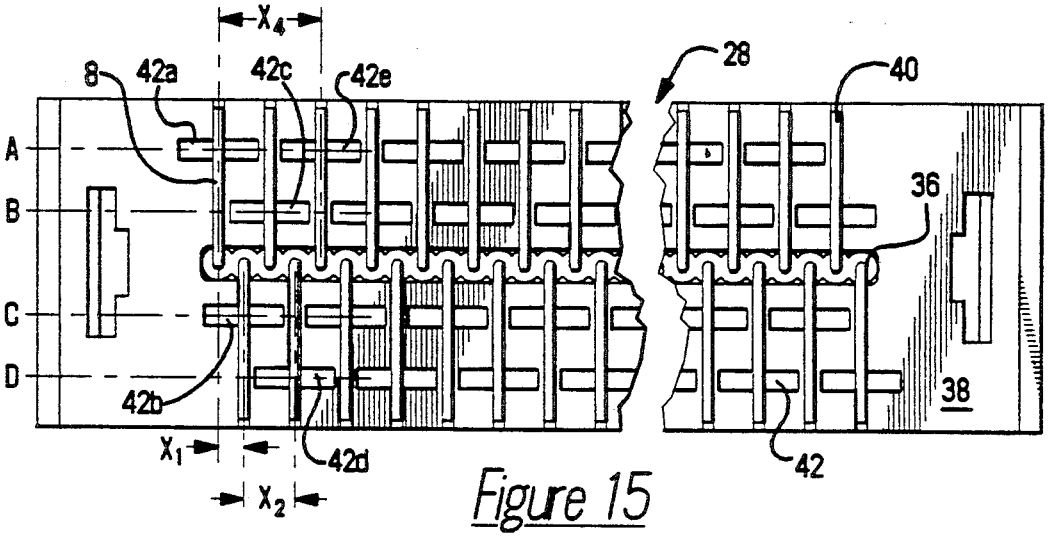
FIG. 15 is a bottom elevational view showing alternate conductors positioned in their respective grooves in the fixture housing.

With respect now to FIG. 5, the lower surface 38 of the housing 28 includes a plurality of wire locating grooves 40 emanating from both sides of the slot 36. As shown in FIGS. 4 and 5, the slots 40 are transversely coinciding with terminal receiving channels 42. As shown in FIG. 5, the terminal receiving channels 42 are positioned in two rows, A and B, on one side of the slot 36, and into two rows, C and D, on the opposite side of the slot 36. Groove 40*a* in row A is in the first lateral position, whereas groove 40*b* is in the second lateral position, and is located in row C on the opposite side of the slot 36. The third lateral position is groove 40*c* in row B whereas the fourth lateral position, groove 40*d*, is in row D. In this manner, by staggering between the rows A and B and by staggering to opposite sides of the slot 36 into the rows C and D, the lateral distance between adjacent grooves in the same row, for example, 40*a* and 40*e*, is equal to four times $X_1$, where $X_1$ is equal to the lateral position between consecutive positions, such as 40*a* and 40*b*. It should also be noted that $X_1$ is equal to the pitch of the conductors 8, as shown in FIG. 15.

As shown in FIG. 3, the recessed cavity 30 defines two upstanding side walls 44 where each side wall includes an aperture 46 profiled to cooperate with locking projections 26*a* and 26*b* on the strain relief halves 14*a* and 14*b*, respectively. With reference still to FIG. 4, the recessed cavity 30 further defines end walls 48 having channels 50 therein. Channels 50 include a T-shaped slot 52 extending between the upper and lower surfaces 32 and 38, as best viewed in FIG. 4. The T-shaped slot 52 is comprised of a tab clearance slot portion 54 and a wide cross slot portion 56. The channel 50 further comprises a tab clearance slot 58 thereby defining an upwardly facing shoulder 60. As shown best in FIG. 4, the end of the through channel 56 has a beveled surface 62 thereby defining a relief area, which will be described in greater detail herein. As also shown best in FIG. 4, the end wall 48 includes curved outer surface 64 approaching the channel 50.

Figure 6:
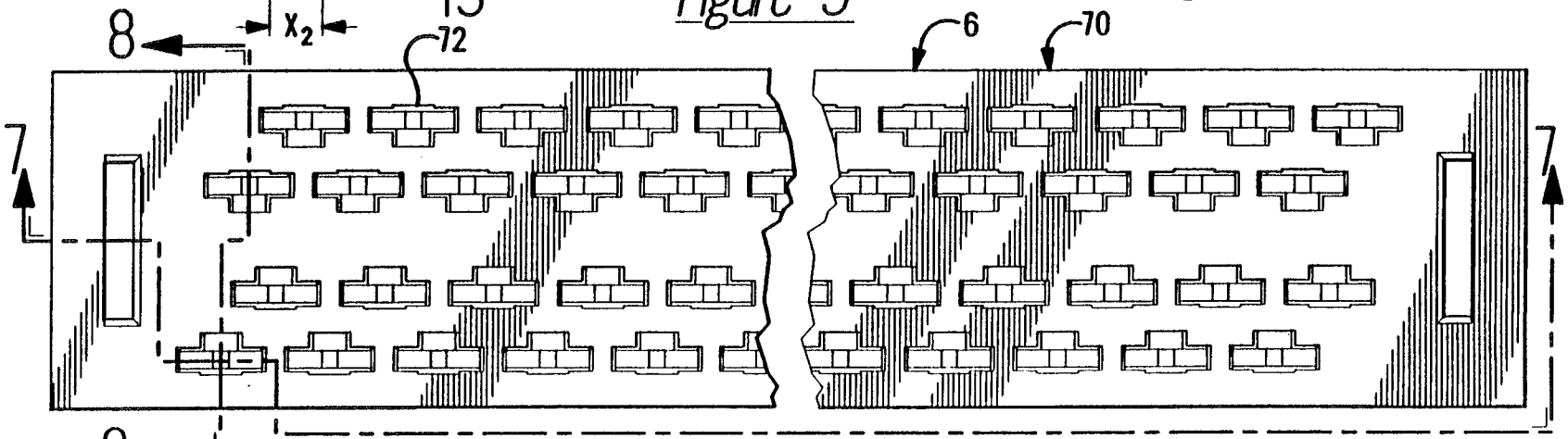
FIG. 6 is a top elevational view of the housing of the receptacle assembly.
Figure 7:
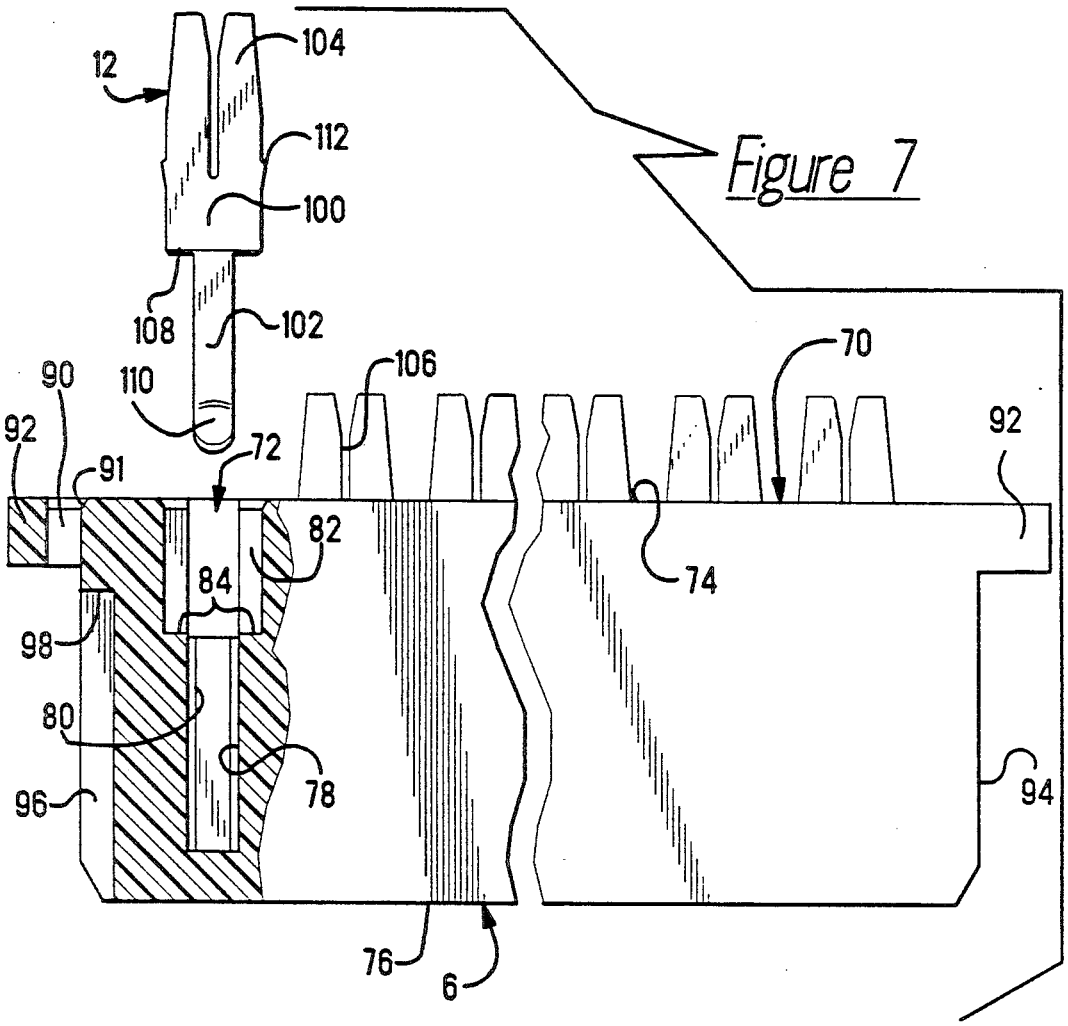
FIG. 7 is a partial cross-sectional view along lines 7—7 of FIG. 6.
Figure 8:
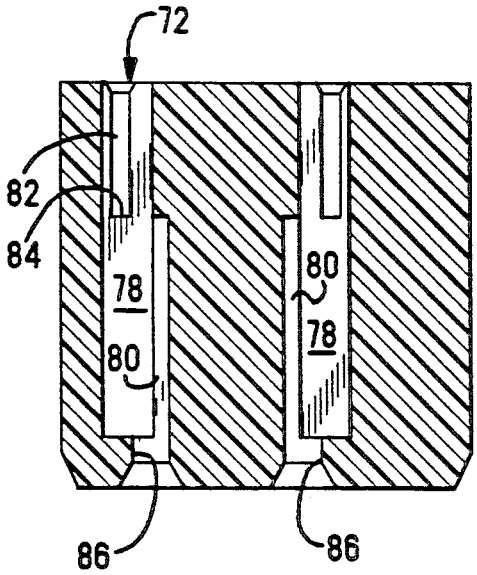
FIG. 8 is a cross-sectional view through lines 8—8 of FIG. 6.

With reference now to FIG. 6–9, the receptacle assembly 6, shown in FIG. 1, will be described in greater detail. With reference first to FIG. 6, the assembly includes a housing shown generally at 70 comprising a plurality of terminal receiving passageways 72 disposed in four discrete staggered rows. It should be appreciated from a comparison of FIGS. 5 and 6, that the array of the passageways 72 is a mirror image of the slots 42 in the fixture housing. As shown in FIG. 7, the slots extend between an inner surface 74 and an outer surface 76 of the housing 70. Each of the passageways 72 is defined by a square passageway 78 intersecting in an off-center manner with a square passageway 80, as best shown in FIG. 8, the passageway 80 being smaller than the passageway 78. The two passageways 78, 80 not only intersect, but axially overlap some distance, as best shown in FIG. 8, the purpose for which will be described in greater detail herein. Extending downwardly from the upper surface 74 are transverse slots 82 which intersect the passageways 78 and extend only partially through the housing 70, thereby defining upwardly facing shoulders 84. The passageways 80 define post-receiving openings 86, as shown best in FIG. 8.

The receptacle housing 70 also includes through slots 90 extending through flanges 92 at the ends of the housing 70, and the end walls 94 include clearance passageways 96 thereby defining downwardly facing shoulders 98 positioned proximate to, but below the slots 90. It should also be appreciated that the through slots 90 of the receptacle housing 6 are in alignment with the passageways 50 at the ends of the fixture housing.

Figure 14:
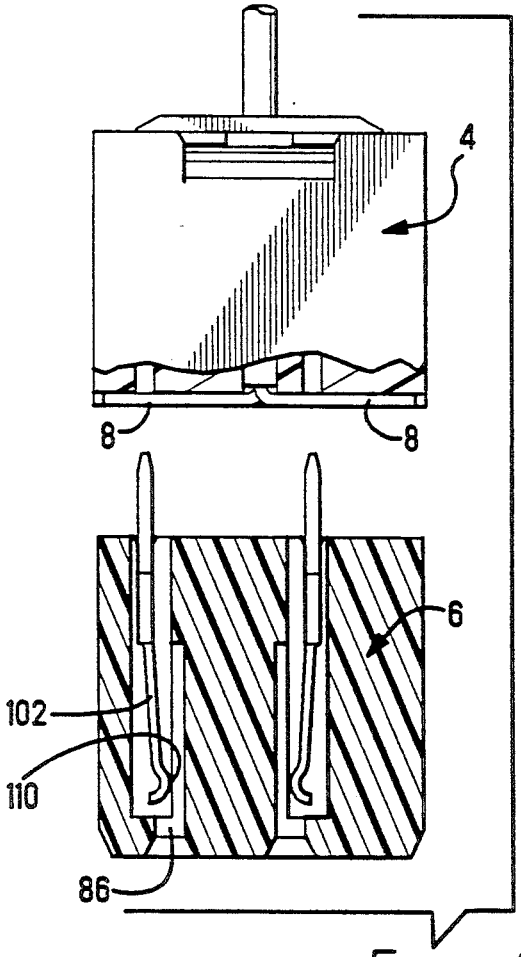
FIG. 14 shows a partial cross-sectional view of the fixture assembly, similar to that of FIG. 13, poised above the receptacle assembly of FIG. 8, with alternate conductors in the high density ribbon cable positioned on opposite sides of the housing.

With reference still to FIG. 7, a receptacle terminal for use in the receptacle housing 70 is shown generally at 12 and comprises a conductor terminating portion 100 integral with a receptacle portion 102. The conductor terminating portion 100 comprises upstanding bifurcated arms 104 spaced apart to define a conductor terminating slot 106. The intersection of the conductor terminating portion 100 and receptacle portion 102 defines a downwardly facing shoulder 108 on the terminal 12. The receptacle portion 102 is defined as a cantilever spring having a resilient contact portion 110 for disposition adjacent to the mating face 76 of the housing 70. As shown in FIG. 7, the terminals 12 are profiled for disposition into the terminal receiving passageways 72 such that the downwardly facing shoulder 108 on the terminal 12 abuts the upwardly facing shoulder 84 in the passageway, thereby positioning the resilient cantilever spring portion 102 within the passageway 78 adjacent to the face 76. As shown in FIG. 14, the cantilever spring portions 102 are angled slightly relative to the conductor terminating portions 100 such that the contact portions 110 extend into the profile of the passageway 80 for interconnection with a mating pin. As also shown in FIG. 7, the terminals 12 include retention barbs 112 along the side edges of the insulation displacement portion 100 thereby retaining the terminals 12 within their respective passageways 72.

Figure 10:
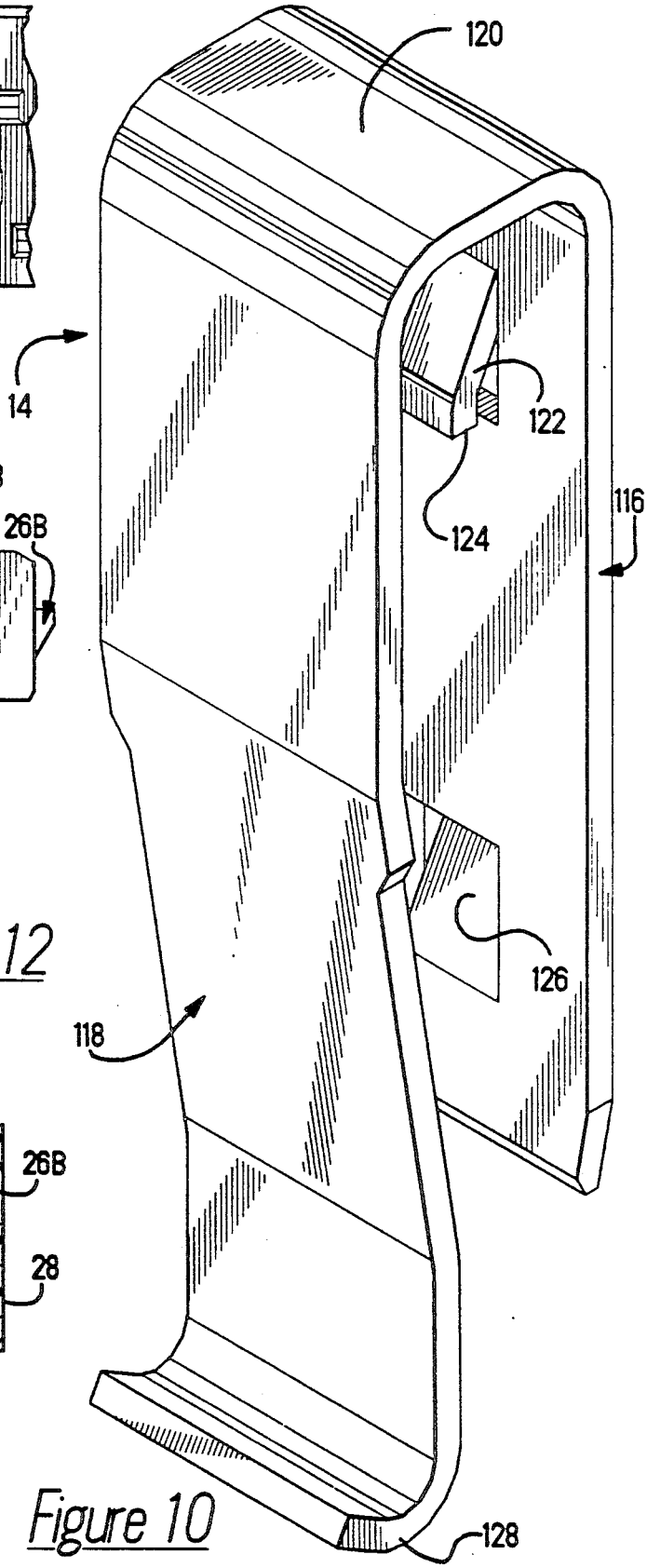
FIG. 10 is a perspective view of the spring latch used to retain the fixture assembly and receptacle assembly together.
Figure 18:
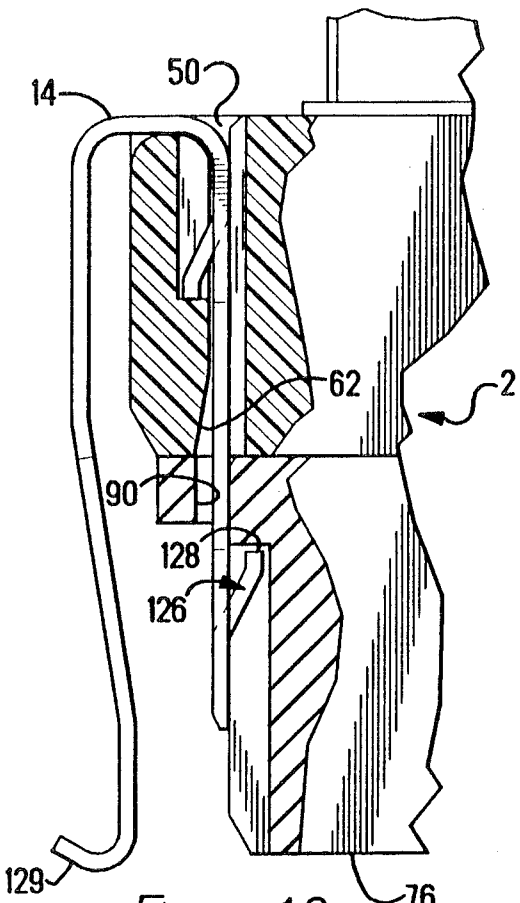
FIG. 18 is a partial cross-sectional view, similar to that of FIG. 17, showing the spring latch in the fully inserted position.
Figure 17:
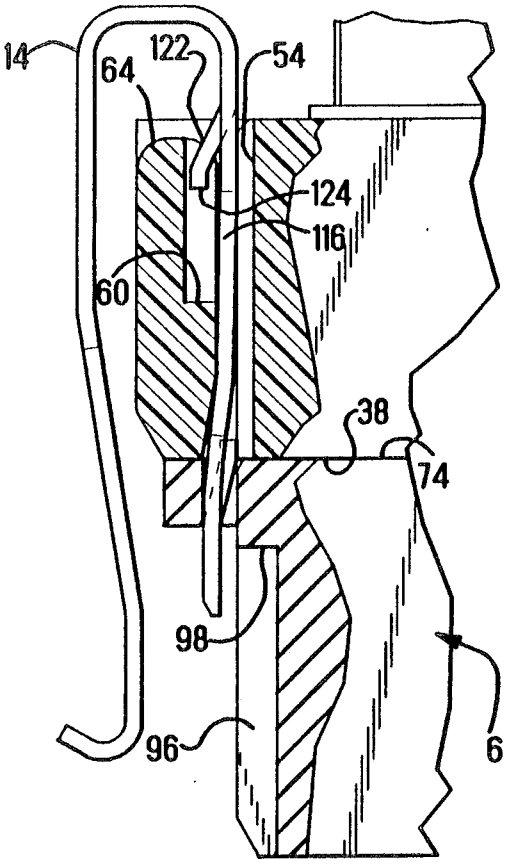
FIG. 17 is a partial cross-sectional view through one end of the fixture and receptacle housing showing the insertion of the spring latch.

With reference now to FIG. 10, a spring latch is shown generally at 14 for retaining the fixture assembly 4 and receptacle assembly 6 together. The spring latch 14 generally includes a base arm 116 interconnected to a spring clip section 118 via a bight portion 120. The base arm 116 includes an upper shear formed tab 122 which extends inwardly towards the spring clip section 118 defining a downwardly facing latch shoulder 124. A second lower shear formed tab 126 extends outwardly of the base plate section 116 to define an upwardly facing latching shoulder 128 (FIG. 18). The free end of the spring clip section 118 is reversely bent at its free end to define a hook member 128 for retaining the receptacle assembly 2 to a mating pin header as further described herein. While the spring latch is described here generally, it is described in greater detail in Applicant's patent application Ser. No. 07660936, filed on even date, now U.S. Pat. No. 5,059,138.

With reference now to FIGS. 10–15, the assembly of the receptacle assembly 2 will be described in greater detail. As shown first in FIG. 11, the high density ribbon cable 10 is prepared by a tool (not shown) having die halves which press against the cable to form the undulation, and subsequently strip the insulation from the ends of the cable to expose the conductors 8. The strain relief halves 14*a* and 14*b*, previously described with reference to FIG. 2, are offered up to the ribbon cable 10 in a transverse direction thereto, to entrap the cable and to position alignment posts 22 within the alignment slots 24.

Figure 12:
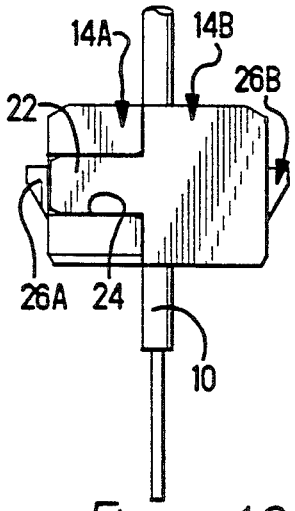
FIG. 12 shows the strain relief halves encompassing the formed ribbon cable.

With the strain relief halves 14*a*, 14*b* and the ribbon cable 10, assembled as shown in FIG. 12, this assembly is positioned within the recessed cavity 30 of the housing 28 such that the ribbon cable 10 is disposed through the slot 36 to position the conductors 8 extending beyond the face 38, as shown in FIG. 13. The strain relief halves 14*a*, 14*b* are positioned into the recessed cavity such that the projections 26*a* and 26*b* are snapped into the apertures 46, as shown in FIG. 13. With the undulation 16 formed at a precise position relative to the ends of the conductors, together with the strain relief halves 14*a*, 14*b*, the conductors 8 are held in axial juxtaposition relative to the face 38 of the fixture housing having the grooves 40.

Figure 20:
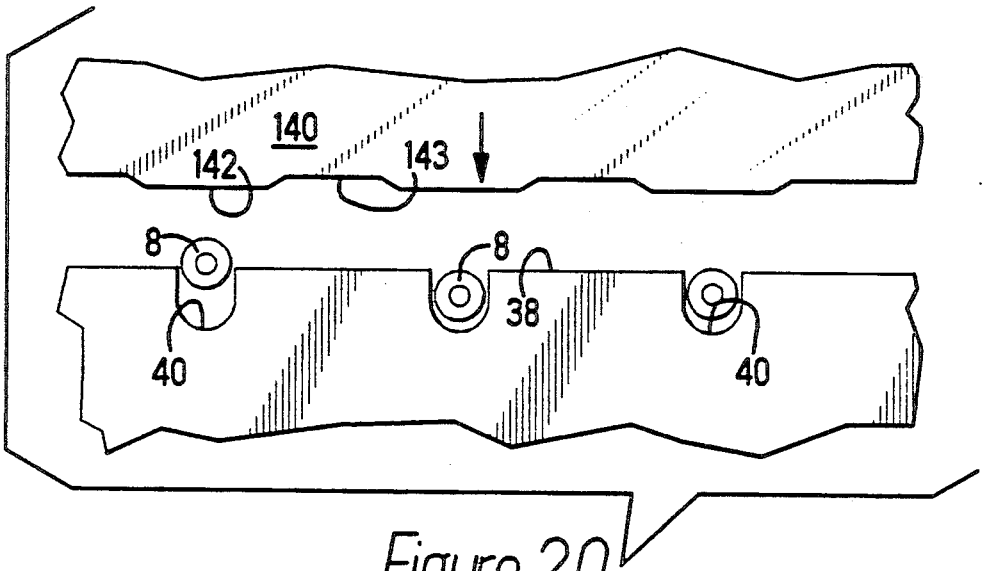
FIG. 20 is a diagrammatical view showing the fixture housing in the same perspective as FIG. 4.
Figure 21:
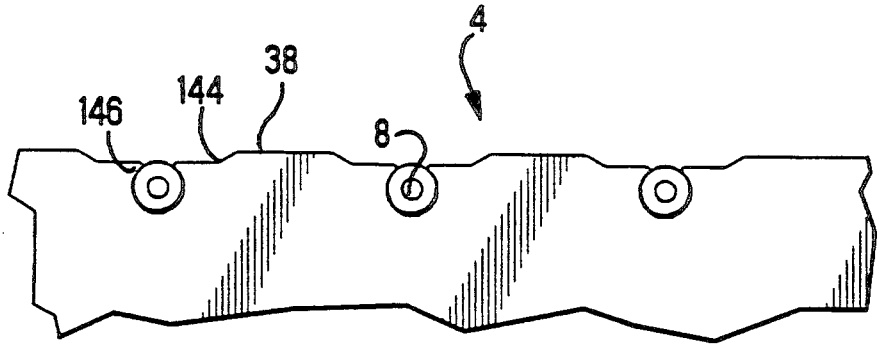
FIG. 21 is an exploded view of the fixture housing after the process shown in FIG. 20.

Conductors 8 are bent upwardly towards the face 38 to position alternating conductors 8 within the grooves 40. If the individual wires experience spring back, such that the wires deflect out of their associated grooves, the fixture housing can be conditioned to retain the individual conductors. As shown in FIG. 20, a blade 140 is positioned above the face 38 of the housing 4, where the blade 140 has a plurality of projections 142 aligned with the grooves 40. The blade 140 is forced against the face 38 until the surface 143 abuts the top face 38 of the housing, causing the formation of indentations 144 over each conductor 8. This deformation of the plastic also causes the material to flow around the conductors, as at 146, to maintain the conductors in place.

As shown in FIG. 15, the conductors 8 are now positioned in the associated alignment grooves 40, in a closely spaced array. As mentioned above, the centerline spacing, or pitch, ($X_1$) between adjacent conductors in the ribbon cable 10 is 0.5 mm. Even though the grooves 40 are spaced apart a distance $X_2$ equal to 1.0 mm, the slots 42*b* and 42*d* are staggered from row C to row D, increasing the centerline spacing between adjacent slots 42 in the same row. For example, as shown in FIG. 15, slots 42*a* and 42*e* in row A are adjacent slots in the same row and are spaced apart a distance $X_4$ equal to 2.0 mm (0.079 inches).

It should be appreciated that the close spacing between adjacent grooves 40 is accomplished by the fixture housing accommodating the bared conductors. Said differently, if the insulation were left on the cable, there would not be adequate side-to-side spacing for conventional insulation piercing contacts. Thus, the fixture housing is not only designed to properly align the bared conductors with the associated terminals 12, the fixture housing also provides for an insulative barrier between adjacent conductors.

Figure 16:
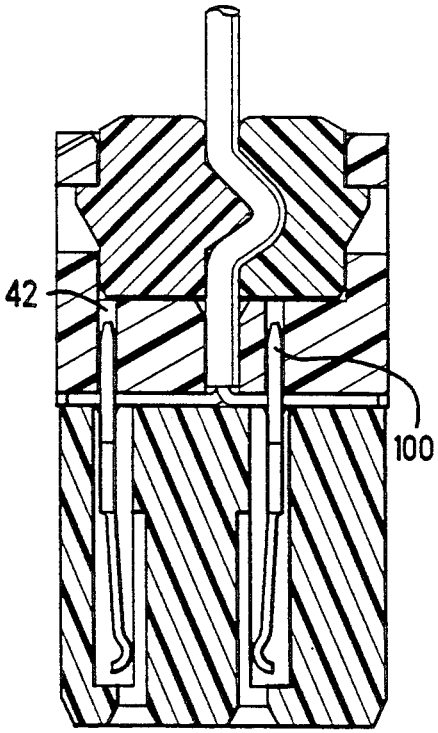
FIG. 16 is a cross-sectional view, similar to that of FIG. 14, showing the fixture and the receptacle assemblies in a mated configuration, with the individual conductors terminated.
Figure 19:
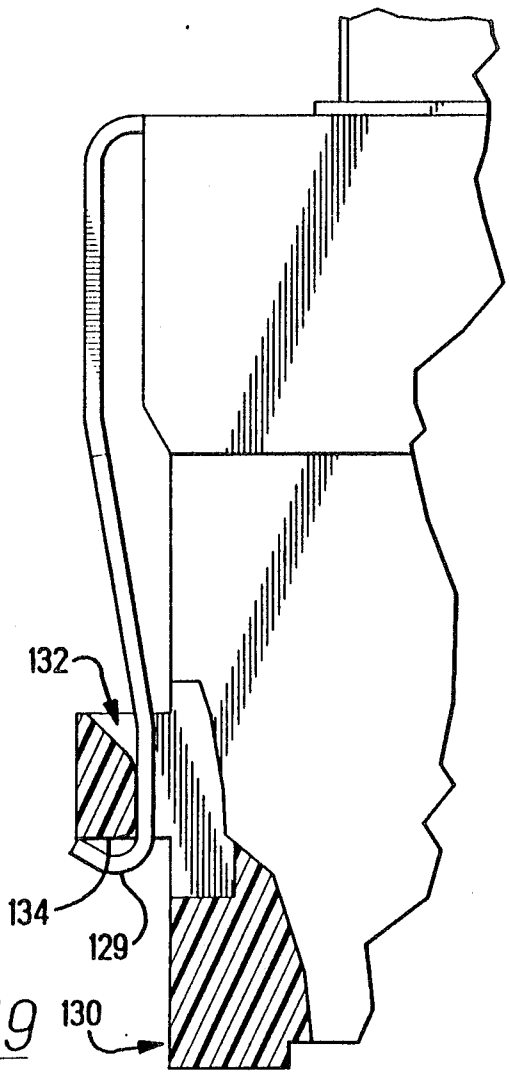
FIG. 19 is a partial cross-sectional view showing the receptacle assembly in a mated configuration with a tab header.

With the individual conductors 8 positioned as shown in FIG. 15, the fixture assembly 4 and receptacle assembly 6 are now brought into abutting relation terminating the individual conductors 8 within the conductor terminating slots 106 (FIG. 7), as shown in FIG. 16. As mentioned previously, the slots 42 and 72 are mirror images of one another, allowing the upper sections of the conductor terminating portions 100 to project into an associated slot 42, as shown in FIG. 16. The two housings are brought into abutment with each other, and the spring latches 14 latch the two housings together, as best shown in FIG. 18.

Figure 9:
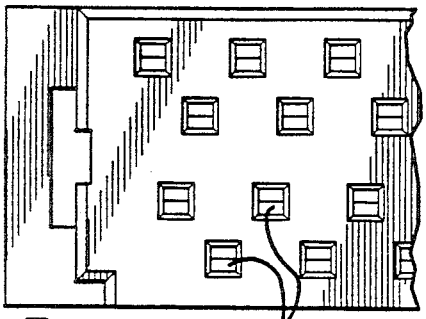
FIG. 9 is a partial bottom elevational view of the receptacle housing.
Figure 11:
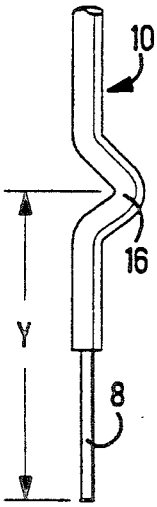
FIG. 11 shows a side view of the formed ribbon cable.

Advantageously then, as assembled in FIG. 16, the receptacle 2 is profiled for mating engagement with a pin header, where the pins are in an array to match the openings 86 as shown in FIG. 9. When the pins are inserted in their respective passageways 86, the receptacle arms are deflected towards the plane extending through the conductor terminating portions. It should be appreciated that the design of the terminal passages allow for such close spacings between rows A & B, and C & D (FIG. 15).

The terminals are outwardly justified and are held in place within the slot portions 82. The cantilevered receptacle arms, rather, are in their normal state, inwardly justified, which gives adequate room for deflection of the arms 102 outwardly towards the outer walls forming the passageways 78. Furthermore, passageways 80 are not aligned with the passages 78, but rather are positioned on the inner side, so as to align with the receptacle contact portions 110. Passageways 80 need only accommodate the pins, and in the preferred embodiment, the passageways 80 are only 0.020 inches wide.

As described above, the receptacle 2 can accommodate a high density cable having 100 conductors of 0.2 mm diameter positioned on a pitch of 0.5 mm. Furthermore, the terminals 12 are positioned in fours rows, where the spacing between the rows of openings 86 is approximately 0.050 inches apart, thereby interconnectable to alike plurality of pins in a pin header mounted to a printed circuit board. Also, by spreading the receptacles out into four such rows, the profile of the pin header is such that the pin headers can be wave soldered to the printed circuit boards without special fixturing.

While the form of apparatus herein described constitute a preferred embodiment of this invention, it is to be understood that the invention is not limited to this precise form of apparatus, and that changes may be made therein without departing from the scope of the invention which is defined in the appended claims.

What is claimed is:

1. An electrical connector for electrically connecting conductors of a high density ribbon cable, comprising:

strain relief means, comprising bipartite strain relief halves, adapted the cable from opposite sides, and span the width of the cable;

a fixture housing comprising an upper face and a lower fixture face, said fixture housing including a recessed cavity extending inwardly from said upper face, and an elongate slot continuous with said cavity and extending through said fixture face, said fixture face including a plurality of terminal clearance slots extending therein, and alignment means to position the conductors of the ribbon cable over said terminal clearance slots, said strain relief halves being adapted to position the ribbon cable through said elongate slot, and maintain axial juxtaposition of said cable relative to said fixture face;

a terminal housing having a mating face and a termination face, and terminal receiving passageways extending between said mating face and said termination face, said terminal receiving passageways being aligned with said terminal clearance slots in said fixture housing; and a plurality of electrical terminals positioned in said terminal receiving passageways, said terminals comprising insulation displacement portions extending above said termination face, said insulation displacement portions being receivable in said terminal receiving slots upon abutment of said terminal housing with said fixture housing.

2. An electrical connector according to claim 1, wherein said strain relief halves are snap latchable into said fixture housing.

3. An electrical connector according to claim 1, wherein one of said strain relief halves includes a projection across a width thereof, while the other said relief half includes a concave indentation.

4. An electrical connector according to claim 1, wherein said alignment means comprises a plurality of laterally spaced alignment grooves emanating from said elongate slot and extending continuously to said terminal clearance slots.

5. An electrical connector according to claim 4, wherein said terminal clearance slots and said alignment grooves are located on both sides of said elongate slot.

6. An electrical connector according to claim 5, wherein said terminal clearance slots are disposed in at least two rows on both sides of said elongate slot.

7. An electrical connector according to claim 6, wherein the centerline spacing between grooves is equal to the pitch of the cable conductors, with alternate grooves positioned on opposite sides of said elongate slot.

8. An electrical connector according to claim 7, wherein alternate grooves on the same side of said elongate slot lead to terminal clearance slots in different rows.

9. An electrical connector for electrically connecting conductors of a high density ribbon cable, comprising:

fixture housing means comprising an elongate slot therethrough adapted to receive the ribbon cable therethrough, said fixture housing comprising a fixture face having two rows of terminal clearance slots on each side of said elongate slot, a plurality of conductor receiving grooves extending from said elongate slot and aligned with and extending over, said terminal clearance slots, said conductor receiving grooves being positioned at distinct lateral positions, the centerline spacing between consecutive conductor receiving grooves being equal to the pitch of the ribbon cable conductors, with every other conductor receiving groove being located on opposite sides of said elongate slot, and every other terminal clearance slot on each side of said elongate slot being in alternating rows, such that the centerline spacing between adjacent terminal clearance slots in the same said row is equal to four times the pitch of the cable conductors; and a terminal receiving housing having a mating face and a termination face, said housing having a plurality of terminals positioned in terminal receiving passageways in said housing with insulation displacement portions extending above said termination face, each said insulation displacement portion being aligned with one selected terminal clearance slot.

10. An electrical connector according to claim 9, wherein said fixture housing means comprises strain relief means and a fixture housing.

11. An electrical connector according to claim 10, wherein said strain relief means comprises bipartite strain relief halves adapted to span the ribbon from opposite sides, said strain relief halves being snap latchable within a recessed cavity within said fixture housing.

12. A high density electrical connection, comprising:

a high density ribbon cable having a plurality of conductors encapsulated in insulative material, said ribbon cable being disposed in a unitary plane, said ribbon cable having said insulative material removed adjacent to a free end thereof to expose said conductors;

upper housing means comprising an elongate slot extending axially through said housing means, leading onto a fixture face, said fixture face comprising a high density array of side-by-side conductor aligning means having a width substantially equal to a diameter of said stripped conductors;

lower housing means comprising terminal passageways extending therethrough with a plurality of terminals disposed therein, said terminals comprising a plurality of conductor contacting sections laterally aligned with said conductor aligning means; and means to retain said upper and lower housing means together in an abutting manner;

said ribbon cable being positioned within said slot of said upper housing means, with alternate conductors being disposed at substantially 90° angles and press fitted between said upper and lower housing means and into electrical connection with said terminals.

13. The electrical connection of claim 12, wherein said conductor contacting sections are insulation displacement portions.

14. The electrical connection of claim 13, wherein said upper housing means includes terminal clearance slots extending into said fixture face.

15. The electrical connection of claim 14, wherein said conductor aligning means comprises a plurality of grooves in the fixture face extending from said elongate slot and over said terminal clearance slots.

16. The electrical connection of claim 15, wherein said terminal clearance slots are disposed in four rows, with two rows on each side of said elongate slot, said terminal clearance slots being staggered between said two rows on each said side of said elongate slot.

17. A method of terminating high density ribbon cable, comprising the steps of:

stripping insulation from a free end of said cable to expose internal conductors;

bending said conductors upwardly to an angle of 90° relative to a plane of said cable, alternate conductors being bent in opposite directions;

positioning conductive means adjacent to said conductors, where said conductive means are positioned on both sides of said cable in at least two rows, each row of conductive means are laterally offset from each other row of conductive means, where some of said rows are positioned proximal to said cable, and some of said rows are positioned distal from said cable;

electrically connecting said conductors to said conductive means.

18. A method according to claim 17, wherein said cable is held fixedly in place to prevent strain at said termination.

19. A method according to claim 18, further comprising the step of forming the cable above said stripped ends to include a concave indentation across a width of said cable, and holding said cable at said formed indentation.

* * * * *

UNITED STATES PATENT AND TRADEMARK OFFICE

CERTIFICATE OF CORRECTION

PATENT NO. : 5,114,362

DATED : 5/19/92

INVENTOR(S) : Billy E. Olsson

It is certified that error appears in the above-identified patent and that said Letters Patent is hereby corrected as shown below:

In Claim 1, Column 8, Line 2 - after "adapted" insert --to clamp--.

Signed and Sealed this

Fourteenth Day of September, 1993

*Attest:*

*Attesting Officer*

BRUCE LEHMAN

*Commissioner of Patents and Trademarks*